United States Patent [19]

Kehlenbach

[11] Patent Number: 4,715,199

[45] Date of Patent: Dec. 29, 1987

[54] HIGH-TEMPERATURE DYEING APPARATUS

[75] Inventor: Guenther Kehlenbach, Wuerselen, Fed. Rep. of Germany

[73] Assignee: H. Krantz GmbH & Co., Aachen, Fed. Rep. of Germany

[21] Appl. No.: 850,013

[22] Filed: Apr. 10, 1986

[30] Foreign Application Priority Data

Apr. 12, 1985 [DE] Fed. Rep. of Germany ..... 3513088

[51] Int. Cl.[4] ..... D06B 5/18; D06B 23/00

[52] U.S. Cl. ..... 68/198; 68/212

[58] Field of Search ..... 68/21, 43, 150, 175, 68/181 R, 189, 195, 198, 212

[56] References Cited

U.S. PATENT DOCUMENTS 2,707,383 5/1955 Newcomb et al. ..... 68/189

3,100,979 8/1963 Stanway ..... 68/189 X 4,217,768 8/1980 Sugimoto ..... 68/189 X

FOREIGN PATENT DOCUMENTS 22763 3/1956 Fed. Rep. of Germany ..... 68/198

*Primary Examiner*—Philip R. Coe

*Attorney, Agent, or Firm*—W. G. Fasse; D. H. Kane, Jr.

[57] ABSTRACT

A cylindrical container (1) is horizontally arranged with its longitudinal axis. The container is subdivided by a flexible membrane (5) into a larger chamber (6) for holding textile material, preferably in a receptacle (3), and dyeing liquor, and a smaller chamber (7) for a pressurized gas. An excess pressure necessary for the high-temperature dyeing process is maintained in the smaller chamber (7) to compensate for changes in the liquor volume. These changes are temperature dependent. It is sufficient if the volume of the smaller chamber (7) is smaller than one-tenth the volume of the larger chamber (6).

7 Claims, 2 Drawing Figures

HIGH-TEMPERATURE DYEING APPARATUS

FIELD OF THE INVENTION

This invention relates to high-temperature dyeing apparatus for textile material.

DESCRIPTION OF THE PRIOR ART

Generally known dyeing apparatus of this kind comprise a cylindrical pressure container for holding the textile material to be dyed. The longitudinal container axis is arranged vertically. As a result of this vertical container arrangement, means for providing a pressure cushion can be arranged simply and in a space-saving manner in the upper part of the container so that the interior space of the container can be kept under excess pressure needed for the high-temperature dyeing process, without materially impairing the holding capacity of the container.

However, similar dyeing apparatus comprising a pressure container arranged with its longitudinal axis horizontally, are also generally known and are preferred for specific kinds of textile material. However, in dyeing apparatus of this kind pressure cushion providing means have a disadvantageous effect on the holding capacity of the container. Thus, conventional dyeing apparatus of this type include means for generating and maintaining the necessary container excess pressure which are arranged outside the pressure container and connected to the inside space of the container through pipelines. These external pressure means are rather complex to produce and to operate, all the more so since the liquor or dyeing solution, which together with the textile material to be dyed fills the pressure container, expands during the heating-up procedure and consequently the excess pressure means additionally have to be provided with a storage device for holding, at least temporarily, any surplus liquor emerging from the container. Moreover, during the dyeing process liquor additions have to be introduced into the dyeing container, which similarly lead to a liquor surplus that also has to be received by the storage device. Finally, the external storage device for the surplus liquor emerging from the container must have appropriate heat insulation and/or a reheating device, so that, depending on the pressure and expansion conditions, liquor flowing back into the container does not disturb the temperature characteristic necessary for the orderly performance of the dyeing process.

OBJECTS OF THE INVENTION

In view of the foregoing it is the aim of the invention to achieve the following objects singly or in combination:

to provide a high-temperature dyeing apparatus of the so-called horizontal type which does not require an external storage for a portion of the liquor to produce and maintain an excess pressure necessary for the high-temperature dyeing process, and to improve textile material/liquor ratio for reducing the production and operating costs for such a dyeing apparatus.

SUMMARY OF THE INVENTION

According to the invention there is provided a high-temperature dyeing apparatus of the so-called horizontal type which does not require any external storage device for a portion of the liquor for producing and maintaining an excess internal pressure necessary for the high-temperature dyeing process. The present apparatus also assures an improved textile material/liquor ratio, whereby the production costs and the operating costs for such a dyeing apparatus have been reduced.

The present high-temperature dyeing apparatus comprises a cylindrical pressure container arranged with its longitudinal axis horizontally and a receptacle for the textile material to be dyed, as well as heating and circulating means for a dyeing liquor acting on the textile material. The interior space of the container is subdivided into at least two chambers which are separated from one another by a membrane, whereby a larger chamber is formed for accommodating the textile material and the liquor, and a smaller chamber to be supplied with a gas under excess pressure.

As a result of the subdivision, in accordance with the invention, of the inner space of the container into two separated chambers it is possible to arrange the chamber for receiving gas under pressure in a region which, in any case, is unsuitable for holding the textile material. In this way the amount of liquor necessary for a complete filling of the container is reduced. If the liquor expands as a result of its being heated, or if liquor additions are fed in, the chamber which is acted upon by gas, is reduced in size through a corresponding deformation of the membrane. If it is necessary to maintain a specific excess pressure gas may escape, for example by way of a pressure valve, while all of the liquor remains in the pressure container. If, on the other hand, the internal pressure of the container is to be increased, this is effected in a simple manner by an increase in the gas pressure, which is transmitted through the membranes to the entire inner space of the container.

Preferably, the membrane is made of silicon forming a ring disc provided with angled inner and outer collars enclosing with a container bottom, an annular space defining the gas chamber. By making use of the container bottom, which is preferably concave on the inside, for the formation of the gas chamber in conjunction with the annular disc-shaped membrane, the gas chamber is located in a part of the inner space of the container which is not, in any case, useable for holding the textile material to be dyed. It is within the scope of the invention to arrange the membrane in the vicinity either of the bottom or of the other charging end of the pressure container.

Preferably, the angled inner collar of the membrane is tightly connected to the outside of a feed pipe extending coaxially into the pressure container, while the angled outer collar of the membrane is tightly connected to the inside of the outer container casing in the vicinity of the container bottom. With this arrangement of the membrane, the gas chamber is arranged in an inner container region which is unsuitable for accommodating the textile material. Moreover, the presence of the feed pipe extending into the pressure container, provides an advantageous fastening possibility for the inner collar of the membrane.

In a preferred embodiment of the invention the inner collar and the outer collar of the membrane each have an edge strip which is angled inwardly, or respectively outwardly, in an approximately U-shaped manner. Each collar encloses a respective clamping ring fastened, by way of screws distributed around its periphery, to the socket or, respectively, to the container outer casing.

As a result of fastening the clamping rings, which are enclosed by said collars of the membrane, to the socket and the container outer casing, the membrane can be installed in a simple way so as to be liquor-tight and gas-tight all around. Except for the collars, the membrane retains a great freedom of movement, so that correspondingly large variations in volume of the two container chambers are ensured.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
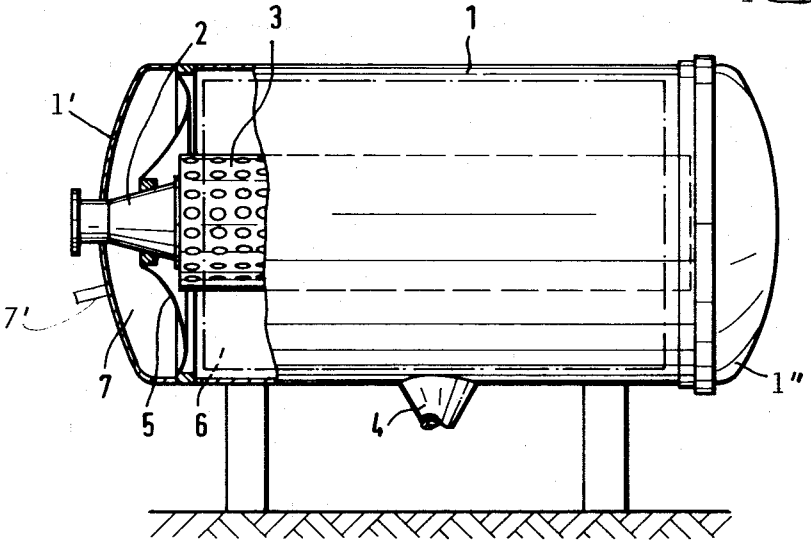
FIG. 1 is a schematic partially vertically sectioned side view of a preferred embodiment of the dyeing apparatus of the invention.

As shown in FIG. 1, the high-temperature dyeing apparatus comprises substantially a cylindrical pressure container 1 which is arranged horizontally with its longitudinal axis.

A pipeline system, not shown, for circulating dyeing liquor is connectable to a feed pipe 2, which extends coaxially into the container 1 through one end. A radially perforated receptacle 3 for holding textile material to be dyed is arranged coaxially in the container 1 and is supplied with dyeing liquor through the feed pipe 2. The dyeing liquor is drawn off through an outlet pipe 4 which is connected radially to the outer casing of the container 1 at the bottom thereof.

The inner space of the container is subdivided by a flexible annular disc-shaped membrane 5, for example made of silicon, into a first larger chamber 6 which accommodates the receptacle 3 and a second smaller chamber 7 which is supplied with pressurized gas through a conventional connection 7' in a container end wall 1'. The connection 7' may be a quick connector for a pressure hose. A venting valve, not shown, is also connected to the container end wall 1'.

Figure 2:
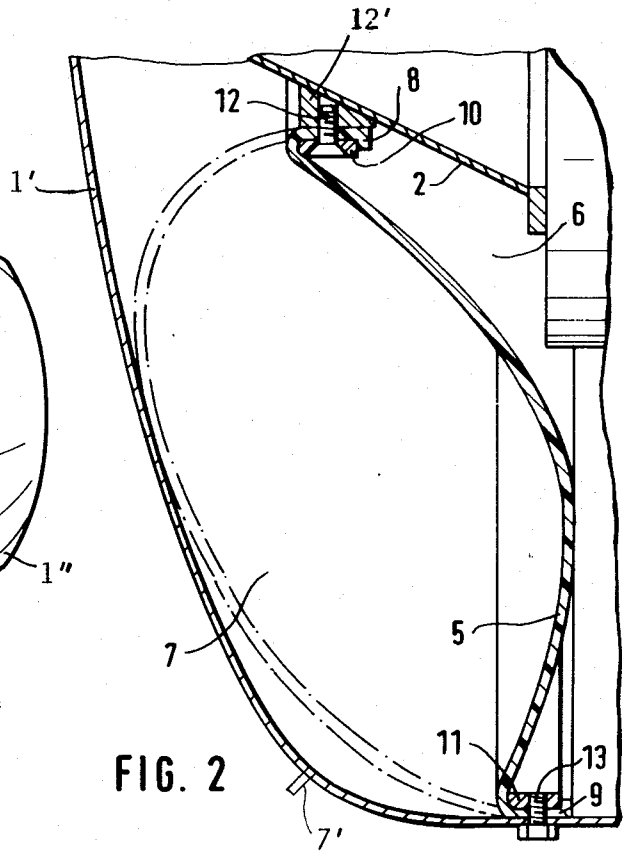
FIG. 2 is a broken-away cross-sectional representation, on an enlarged scale, of the dyeing apparatus of FIG. 1 in the region of the membrane.

As shown in FIG. 2, the membrane 5 has an angled inner collar 8 and a similarly angled outer collar 9, each of which encloses a respective clamping ring 10, 11. The inner ring 10 and the collar 8 are fastened by radially extending uniformly distributed screws 12 to a flange ring 12' of the feed pipe 2 inside the container 1. The outer ring 11 and the collar 9 are connected to the inside of the outer wall of the pressure container 1 by radially inwardly extending screws 13.

The volume of the annular chamber 7 between the container end wall 1' and the membrane 5 is so dimensioned that at least the liquor expansion to be expected due to the heating of the liquor to a temperature between 80° C. and 140° C. during the heating-up phase and any dye recharge into the chamber 6 that may become necessary, may be compensated.

In a dyeing apparatus according to the invention, an operational dyeing cycle may be as follows.

After the chamber 6, or rather the receptacle 3, is filled with textile material to be dyed, pressure is applied in the smaller chamber 7 at a level of at least 0.8 bar over the hydrostatic liquor pressure to be expected after filling of the chamber 6, for example 0.12 bar in the case of a container diameter of 1,200 mm. Thereafter, the chamber 6 is filled with liquor to a specific level, so that initially, a liquor-free space remains inside the chamber 6. This space is available for liquor expansion during the heating-up phase up to 80° C. Up to this point in the operational cycle, chamber 6 remains vented.

During the subsequent continuation of the heating phase up to the process temperature, the pressure in the chamber 7 is raised right up to a maximum of 4.5 bar. Then the process proceeds under constant pressure conditions.

Finally, the liquor is cooled by an appropriate reduction of the pressure in the chamber 7 down to 0.2 bar, whereupon the liquor is drained off, a rinsing step is performed, and the dyed textile material is removed from the receptacle 3 which, incidentally, has perforations as shown.

For this arrangement to function effectively in generating and maintaining the excess pressure necessary for the high temperature dyeing process and for compensating the liquor volume which changes in a temperature-dependent manner, it is sufficient if the volume of the smaller chamber 7 is less than one tenth the volume of the larger chamber 6.

The end wall 1' of the container is conventionally connected to the container, for example, by welding. A further end wall is formed by a cover member 1" also conventionally secured to the opposite end of the container.

Although the invention has been described with reference to specific example embodiments, it will be appreciated, that it is intended to cover all modifications and equivalents within the scope of the appended claims.

What I claim is:

1. An apparatus for dyeing materials at high temperatures, comprising a cylindrical pressure container having a horizontally extending axis, means mounted in said pressure container for holding material to be dyed, dyeing liquid inlet and outlet means connected to said pressure container for circulating said dyeing liquid through said pressure container, flexible membrane means inside said pressure container for dividing said pressure container into a first chamber and into a second chamber smaller than said first chamber, means for mounting said flexible membrane means inside said pressure container, and means for admitting a pressurized medium into said second smaller chamber for maintaining a required operating pressure in said first larger chamber through said flexible membrane means.

2. The apparatus of claim 1, wherein said flexible membrane means comprises a disc made of silicon, said disc having an angled outer collar (9) for connection to a container wall, said container having an end wall enclosing with said disc an annular space defining the smaller chamber for pressurized gas.

3. The apparatus of claim 2, wherein said flexible membrane disc is a ring disc also having an angled inner collar (8), said dyeing liquid inlet and outlet means comprising a feed pipe, said mounting means for said flexible membrane means securing said angled inner collar of said membrane means in a pressure-tight manner to said feed pipe extending coaxially into said pressure container through said end wall, and wherein said angled outer collar of said flexible membrane is tightly connected to an inside of said container wall near said container end wall.

4. The apparatus of claim 3, wherein said inner and outer collars of said flexible membrane means have an approximately U-shaped cross-sectional configuration, with respective inwardly angling inner and outer collar portions, said mounting means comprising an inner mounting ring (10) and an outer mounting ring (11) enclosed by the respective collar portion, and means (12, 13) for fastening the respective mounting ring to said container and to said feed pipe so that said inner collar portion is clamped between said inner mounting ring and said feed pipe, and so that said outer collar portion is clamped beween said outer mounting ring and said container wall.

5. The apparatus of claim 4, wherein said fastening means comprise screws extending radially inwardly through said container wall, through said outer collar portion into said outer mounting ring, and further screws extending radially inwardly through said inner mounting ring, through said inner collar portion into said feed pipe.

6. The apparatus of claim 5, further comprising a flange ring (12') on said feed pipe, said further screws extending radially into said flange ring for securing said inner collar portion of said flexible membrane means.

7. The apparatus of claim 1, wherein said second smaller chamber has a volume which is less than about one tenth of the volume of said first larger chamber.

* * * * *